US007395567B1

(12) United States Patent
Tetzler

(10) Patent No.: US 7,395,567 B1
(45) Date of Patent: Jul. 8, 2008

(54) SHEET RETENTION SYSTEM

(76) Inventor: Charles Tetzler, 11820 Minneola Dr., New Port Richey, FL (US) 34654

( * ) Notice: Subject to any disclaimer, the term of this patent is extended or adjusted under 35 U.S.C. 154(b) by 0 days.

(21) Appl. No.: 11/593,342

(22) Filed: Nov. 6, 2006

(51) Int. Cl.
*A47G 9/04* (2006.01)

(52) U.S. Cl. ..... 5/669

(58) Field of Classification Search ..... 5/669, 5/678, 665, 496, 498; 24/72.5
See application file for complete search history.

(56) References Cited

U.S. PATENT DOCUMENTS 959,763 A 5/1910 Lehr
2,826,766 A 3/1958 Stoner
4,100,632 A * 7/1978 Johnson ..... 5/496
4,506,398 A * 3/1985 Hruban ..... 5/669
5,044,028 A 9/1991 Sleeth

* cited by examiner

*Primary Examiner*—Alexander Grosz
(74) *Attorney, Agent, or Firm*—Louis J. Brunoforte

(57) ABSTRACT

A rail assembly is formed of rails equal to the length of side faces of a waterbed. Each of the rails has a common cross sectional configuration. Each of the rails has a flat rear face and with sloping faces. The sloping faces extend forwardly and terminating in a groove. The groove has inwardly extending parallel surfaces. The parallel surfaces have a common spacing and terminate in a semi-cylindrical surface. Coupling components include screws. The screws extend through the rails. The screws are adapted to couple with sides of a waterbed. A plurality of similarly configured rods each have a cylindrical configuration. The rods have a diameter slightly less than the spacing between the sides of the groove and the diameter of the semi-cylindrical surfaces.

2 Claims, 3 Drawing Sheets

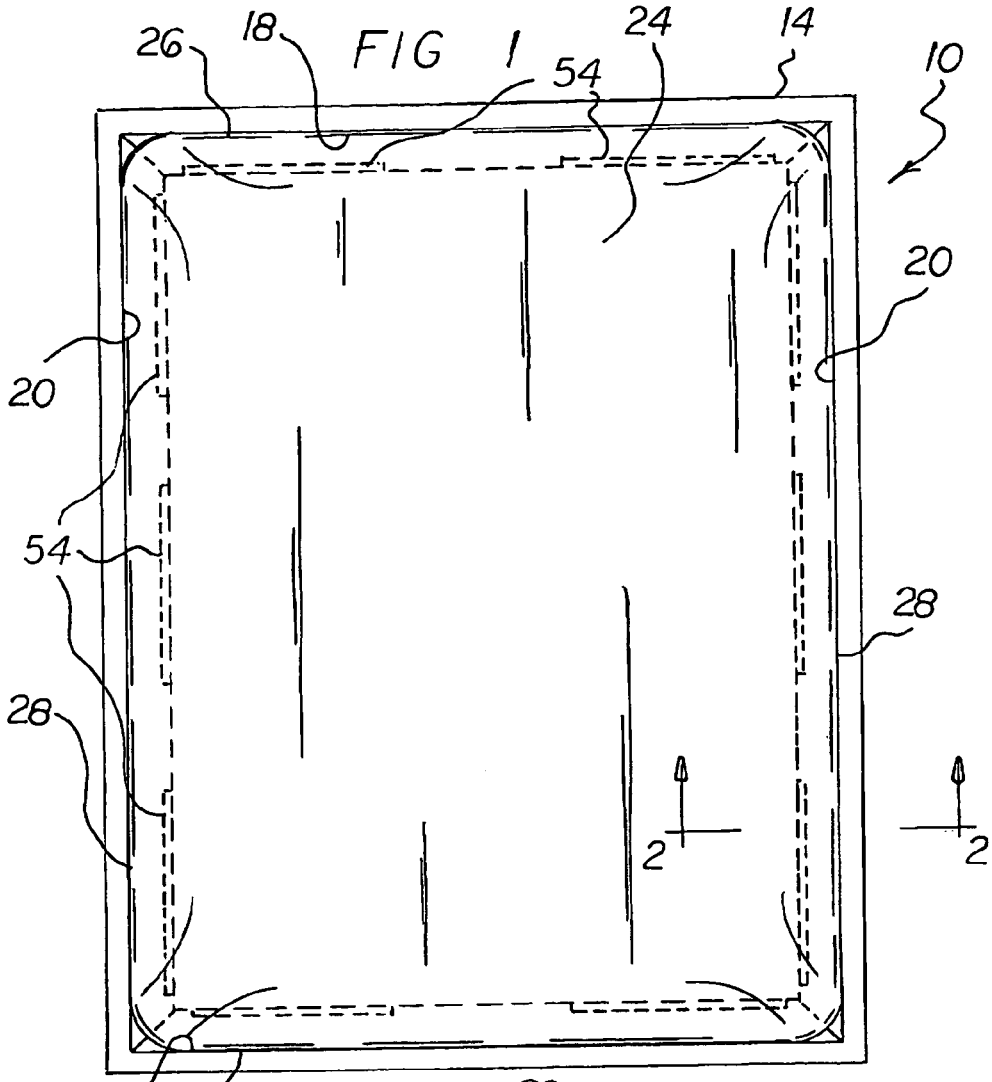
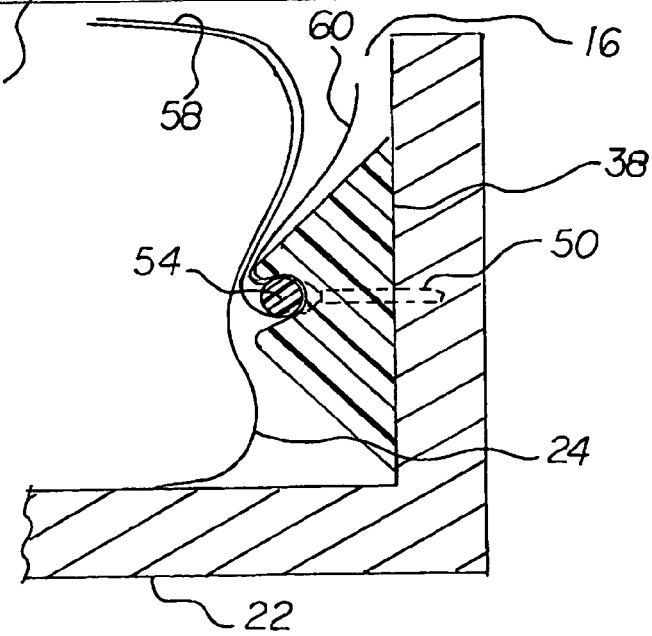
FIG 2

FIG 3
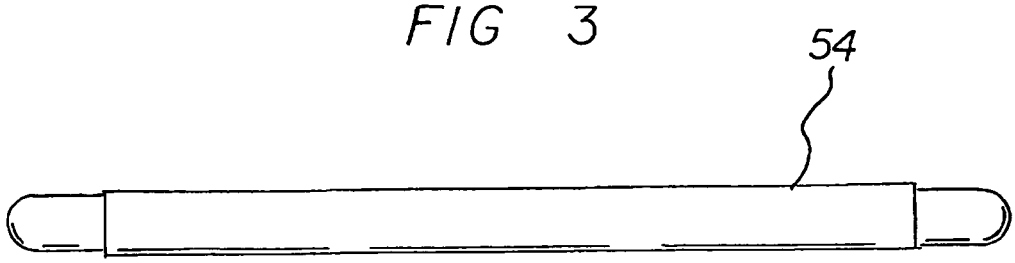
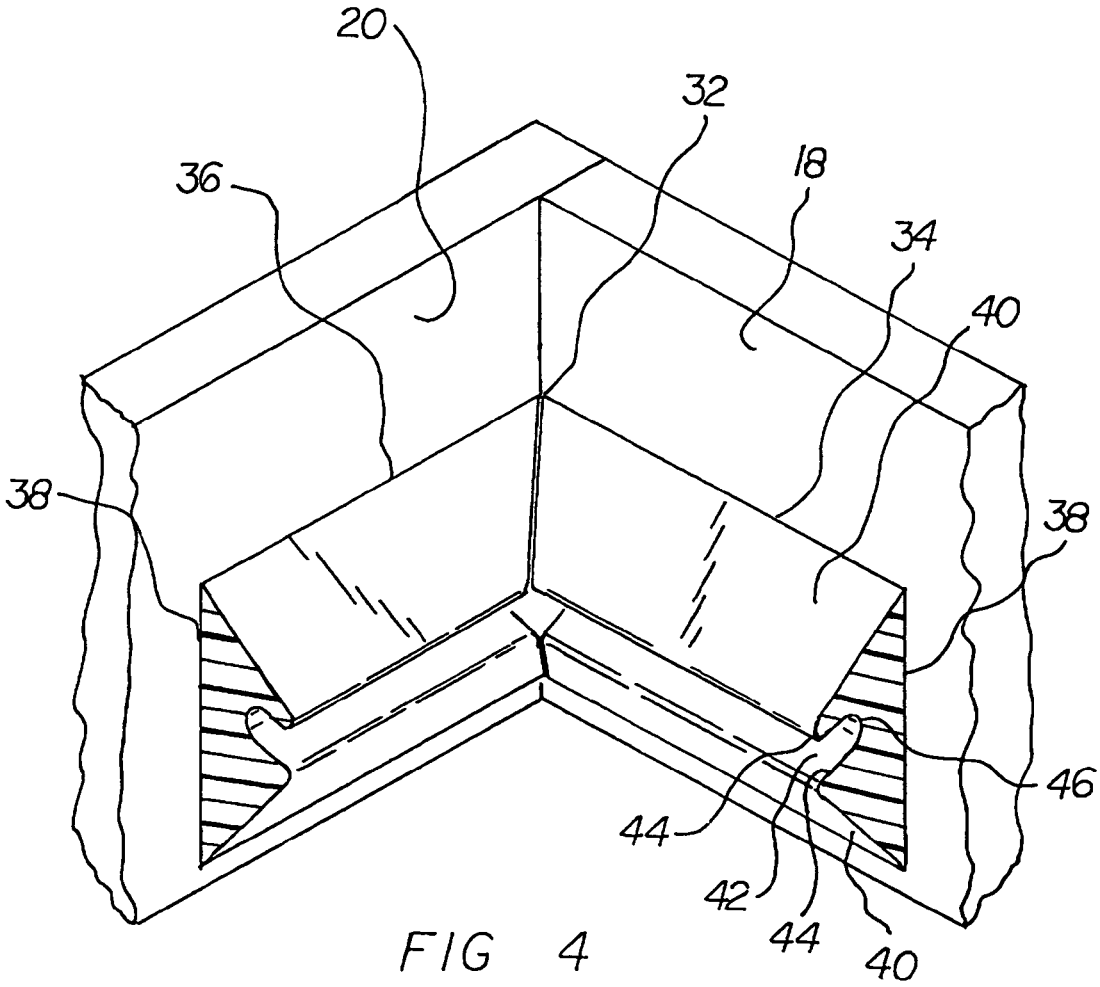
FIG 4

FIG 5
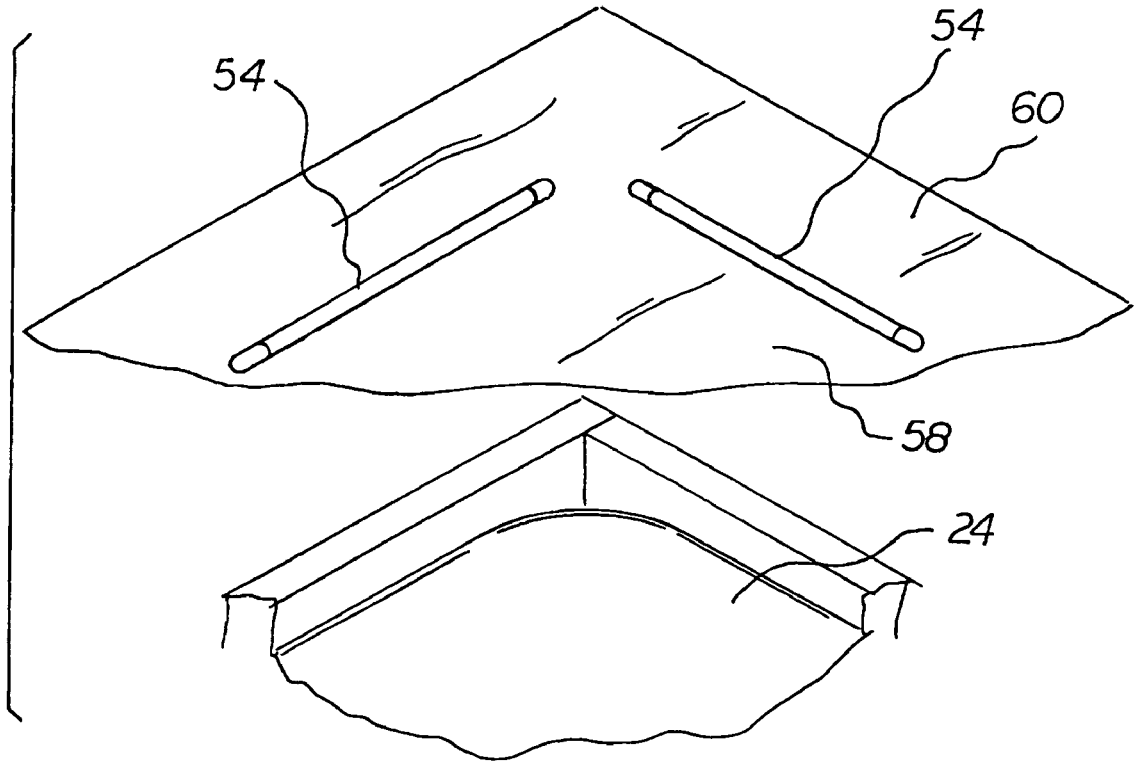
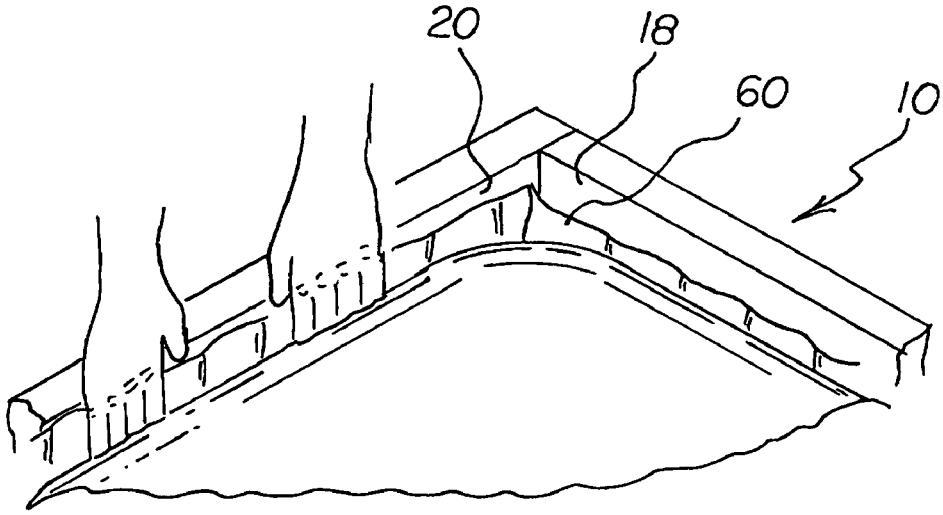
FIG 6

SHEET RETENTION SYSTEM

BACKGROUND OF THE INVENTION

1. Field of the Invention

The present invention relates to a sheet retention system and more particularly pertains to properly positioning sheets and other bedding with respect to a hard side waterbed in a convenient and economical manner.

2. Description of the Prior Art

The use of sheet holders of known designs and configurations is known in the prior art. More specifically, sheet holders of known designs and configurations previously devised and utilized for the purpose of retaining bed sheets through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 959,763 issued May 31, 1910 to Lehr relates to a Bedclothes Holder. U.S. Pat. No. 2,826,766 issued Mar. 18, 1958 to Stoner relates to a Bed Clothes Holder. Lastly, U.S. Pat. No. 5,044,028 issued Sep. 3, 1991 to Sleeth relates to Waterbed Sheet Retention Systems.

While these devices fulfill their respective, particular objectives and requirements, the aforementioned patents do not describe a sheet retention system that allows properly positioning sheets and other bedding with respect to a hard side waterbed in a convenient and economical manner.

In this respect, the sheet retention system according to the present invention substantially departs from the conventional concepts and designs of the prior art, and in doing so provides an apparatus primarily developed for the purpose of properly positioning sheets and other bedding with respect to a hard side waterbed in a convenient and economical manner.

Therefore, it can be appreciated that there exists a continuing need for a new and improved sheet retention system which can be used for properly positioning sheets and other bedding with respect to a hard side waterbed in a convenient and economical manner. In this regard, the present invention substantially fulfills this need.

SUMMARY OF THE INVENTION

In view of the foregoing disadvantages inherent in the known types of sheet holders of known designs and configurations now present in the prior art, the present invention provides an improved sheet retention system. As such, the general purpose of the present invention, which will be described subsequently in greater detail, is to provide a new and improved sheet retention system and method which has all the advantages of the prior art and none of the disadvantages.

To attain this, the present invention essentially comprises a sheet retention system. First provided is a waterbed. The waterbed has a rectilinear opening. The rectangular opening is formed by parallel vertical end faces. The end faces are of a common length laterally. The rectangular opening is further formed by parallel vertical side faces. The side faces are of a common length longitudinally. The opening has an open rectangular top and a horizontal bottom. The horizontal bottom couples the four faces. A water filled mattress is provided in the opening. The water filled mattress has parallel vertical end faces laterally. The water filled mattress has parallel vertical side faces longitudinally. The faces of the waterbed are in proximity to the faces of the opening.

A rail assembly is provided. The rail assembly is formed of four linear rails. The rails include two parallel end rails. The end rails are of a common length essentially equal to the length of the end faces of the opening. The end rails are secured to the end faces of the opening. The rails include two parallel side rails. The side rails are of a common length essentially equal to the length of the side faces of the opening. The side rails are secured to the side faces of the opening.

Each of the rails has a common cross sectional configuration. Each of the rails has a flat rear face. The rear face is coupled to faces of the opening adjacent to the bottom. Each of the rails has sloping faces. The sloping faces extend forwardly toward the mattress. The sloping faces terminate in a groove. The groove has inwardly extending parallel surfaces. The parallel surfaces have a common spacing. The parallel surfaces terminate in a semi-cylindrical surface. The parallel surfaces extend downwardly at an angle of about 30 degrees with respect to the bottom. The rails are fabricated of an elastomeric material. The elastomeric material is selected from the class of elastomeric materials. The class of elastomeric materials includes plastic and rubber, natural and synthetic, and blends thereof.

Provided next are coupling components. The coupling components include screws. The screws extend horizontally through the rails at space locations along the lengths of the rails from the semi-cylindrical surfaces. The screws extend into the faces of the opening. The semi-cylindrical surfaces are formed with countersunk holes. In this manner the screws are recessed with respect to the grooves.

Further provided is a plurality of similarly configured rods. Each rod has a cylindrical configuration. Each rod has a diameter slightly less than the spacing between the sides of the groove and the diameter of the semi-cylindrical surfaces. Each rod has a common length of between about 6 and 30 inches. In this manner a plurality of rods are adapted to be positioned into each of the grooves. The rods are fabricated of an essentially rigid material. The essentially rigid material is selected from the class of essentially rigid materials. The class of essentially rigid materials includes wood, metal, plastic and rubber. Each rod has an exterior surface. The exterior surface has a coating of a rubberized material.

Provided last is a sheet. The sheet has a rectangular configuration greater than the opening of the waterbed. In this manner an extended rectangular periphery is provided. The sheet is adapted to be positioned over the mattress with the periphery extending downwardly between the mattress and the rails. In this manner a user is adapted to entrain the periphery around a plurality of rods and insert the rods and entrained peripheries into the grooves. Further in this manner the retention system will properly position the sheet with respect to the rails and the waterbed in a convenient and economical manner while allowing for the convenient and economical separation of the sheet and rods from the rails and waterbed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sheet retention system which has all of the advantages of the prior art sheet holders of known designs and configurations and none of the disadvantages.

It is another object of the present invention to provide a new and improved sheet retention system which may be easily and efficiently manufactured and marketed.

It is further object of the present invention to provide a new and improved sheet retention system which is of durable and reliable constructions.

An even further object of the present invention is to provide a new and improved sheet retention system which is susceptible of a low cost of manufacture with regard to both materials and labor, and which accordingly is then susceptible of low prices of sale to the consuming public, thereby making such sheet retention system economically available to the buying public.

Even still another object of the present invention is to provide a sheet retention system for properly positioning sheets and other bedding with respect to a hard side waterbed in a convenient and economical manner.

Lastly, it is an object of the present invention to provide a new and improved sheet retention system. A rail assembly is formed of rails equal to the length of the side faces of a waterbed. Each of the rails has a common cross sectional configuration. Each of the rails has a flat rear face and with sloping faces. The sloping faces extend forwardly and terminating in a groove. The groove has inwardly extending parallel surfaces. The parallel surfaces have a common spacing and terminate in a semi-cylindrical surface. Coupling components include screws. The screws extend through the rails. The screws are adapted to couple with sides of a waterbed. A plurality of similarly configured rods each have a cylindrical configuration. The rods have a diameter slightly less than the spacing between the sides of the groove and the diameter of the semi-cylindrical surfaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a sheet retention system constructed in accordance with the principles of the present invention.

FIG. 2 is a cross sectional view taken along line 2-2 of FIG. 1.

FIG. 3 is a front elevational view of one of the rods illustrated in FIGS. 1 and 2.

FIG. 4 is a perspective illustration of one corner of a waterbed and rails illustrated in FIGS. 1 and 2.

FIG. 5 is an exploded perspective of one corner of a waterbed with a sheet and rails illustrated in the prior Figures.

FIG. 6 is a perspective illustration similar to FIG. 5 but with a user inserting a rail and sheet into the groove of a rail.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved sheet retention system embodying the principles and concepts of the present invention and generally designated by the reference numeral 10 will be described.

The present invention, the sheet retention system 10 is comprised of a plurality of components. Such components in their broadest context include a rail assembly, coupling components and a plurality of similarly configured rods. Such components are individually configured and correlated with respect to each other so as to attain the desired objective.

First provided is a waterbed 14. The waterbed has a rectilinear opening 16. The rectangular opening is formed by parallel vertical end faces 18. The end faces are of a common length laterally. The rectangular opening is further formed by parallel vertical side faces 20. The side faces are of a common length longitudinally. The opening has an open rectangular top and a horizontal bottom 22. The horizontal bottom couples the four faces. A water filled mattress 24 is provided in the opening. The water filled mattress has parallel vertical end faces 26 laterally. The water filled mattress has parallel vertical side faces 28 longitudinally. The faces of the waterbed are in proximity to the faces of the opening.

A rail assembly 32 is provided. The rail assembly is formed of four linear rails. The rails include two parallel end rails 34. The end rails are of a common length essentially equal to the length of the end faces of the opening. The end rails are secured to the end faces of the opening. The rails include two parallel side rails 36. The side rails are of a common length essentially equal to the length of the side faces of the opening. The side rails are secured to the side faces of the opening.

Each of the rails has a common cross sectional configuration. Note FIGS. 2 and 4. Each of the rails has a flat rear face 38. The rear face is coupled to faces of the opening adjacent to the bottom. Each of the rails has sloping faces 40. The sloping faces extend forwardly toward the mattress. The sloping faces terminate in a groove 42. The groove has inwardly extending parallel surfaces 44. The parallel surfaces have a common spacing. The parallel surfaces terminate in a semi-cylindrical surface 46. The parallel surfaces extend downwardly at an angle of about 30 degrees with respect to the bottom. The rails are fabricated of an elastomeric material with limited elasticity. The elastomeric material is selected from the class of elastomeric materials. The class of elastomeric materials includes plastic and rubber, natural and synthetic, and blends thereof.

Provided next are coupling components. The coupling components include screws 50. The screws extend horizontally through the rails at space locations along the lengths of the rails from the semi-cylindrical surfaces. The screws extend into the faces of the opening. The semi-cylindrical surfaces are formed with countersunk holes. In this manner the screws are recessed with respect to the grooves. Note FIG. 2.

Further provided is a plurality of similarly configured rods 54. Each rod has a cylindrical configuration. Each rod has a diameter slightly less than the spacing between the sides of the groove and the diameter of the semi-cylindrical surfaces. Each rod has a common length of between about 6 and 30 inches. In this manner a plurality of rods are adapted to be positioned into each of the grooves. The rods are fabricated of an essentially rigid material. The essentially rigid material is selected from the class of essentially rigid materials. The class of essentially rigid materials includes wood, metal, plastic and rubber. Each rod has an exterior surface. The exterior surface has a coating of a rubberized material. The coating is preferably on the central extent of each rod as shown leaving the tapering ends free of a coating. In an alternate embodiment, the coating is over the entire exterior surface of each rod.

Provided last is a sheet 58. The sheet has a rectangular configuration greater than the opening of the waterbed. An extended rectangular periphery 60 is thus provided. The sheet is adapted to be positioned over the mattress with the periphery extending downwardly between the mattress and the rails. In use, a user is adapted to entrain the periphery around a plurality of rods and insert the rods and entrained peripheries into the grooves. Note FIG. 2. Further in this manner the retention system will properly position the sheet with respect to the rails and the waterbed in a convenient and economical manner while allowing for the convenient and economical separation of the sheet and rods from the rails and waterbed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sheet retention system comprising:

a rail assembly formed of rails equal to the length of side faces of a waterbed, each of the rails having a common cross sectional configuration with a flat rear face and with sloping faces extending forwardly and terminating in a groove, the groove having inwardly extending parallel surfaces with a common spacing and terminating in a semi-cylindrical surface;

coupling components including screws extending through the rails and adapted to couple with sides of a waterbed; and a plurality of similarly configured rods each having a cylindrical configuration with a diameter slightly less than the spacing between the sides of the groove and the diameter of the semi-cylindrical surfaces; and a sheet having a rectangular configuration with an extended rectangular periphery, the sheet adapted to be positioned over a waterbed with the periphery extending whereby a user is adapted to entrain the periphery around a plurality of rods and insert the rods and entrained peripheries into the grooves whereby the retention system will properly position the sheet with respect to the rails and a waterbed in a convenient and economical manner while allowing for the convenient and economical separation of the sheet and rods from the rails.

2. A sheet retention system for properly positioning sheets and other bedding with respect to a hard side waterbed in a convenient and economical manner comprising, in combination:

a waterbed having a rectilinear opening formed by parallel vertical end faces of a common length laterally and parallel vertical side faces of a common length longitudinally, the opening having an open rectangular top and a horizontal bottom coupling the four faces, and a water filled mattress in the opening, the water filled mattress having parallel vertical end faces laterally and parallel vertical side faces longitudinally, the faces of the waterbed being in proximity to the faces of the opening;

a rail assembly formed of four linear rails including two parallel end rails of a common length essentially equal to the length of the end faces of the opening and secured to the end faces of the opening and two parallel side rails of a common length essentially equal to the length of the side faces of the opening, each of the rails having a common cross sectional, configuration with a flat rear face coupled to faces of the opening adjacent to the bottom and with sloping faces extending forwardly toward the mattress and terminating in a groove, the groove having inwardly extending parallel surfaces with a common spacing and terminating in a semi-cylindrical surface, the parallel surfaces extending downwardly at an angle of about 30 degrees with respect to the bottom, the rails being fabricated of an elastomeric material selected from the class of elastomeric materials including plastic and rubber, natural and synthetic, and blends thereof;

coupling components including screws extending horizontally through the rails at space locations along the lengths of the rails from the semi-cylindrical surfaces and extending into the faces of the opening, the semi-cylindrical surfaces being formed with countersunk holes fro recessing the screws with respect to the grooves;

a plurality of similarly configures rods, each rod having a cylindrical configuration with a diameter slightly less than the spacing between the sides of the groove and the diameter of the semi-cylindrical surfaces, each rod having a common length of between about 6 and 30 inches whereby a plurality of rods are adapted to be positioned into each of the grooves, the rods being fabricated of an essentially rigid material selected from the class of essentially materials including wood, metal, plastic and rubber, each rod having an exterior surface with a coating of a rubberized material; and a sheet having a rectangular configuration greater than the opening of the waterbed to provide an extended rectangular periphery, the sheet adapted to be positioned over the mattress with the periphery extending downwardly between the mattress and the rails whereby a user is adapted to entrain the periphery around a plurality of rods and insert the rods and entrained peripheries into the grooves whereby the retention system will properly position the sheet with respect to the rails and the waterbed in a convenient and economical manner while allowing for the convenient and economical separation of the sheet and rods from the rails and waterbed.

* * * * *